United States Patent [19]

Nessfield

[11] 4,355,732

[45] Oct. 26, 1982

[54] FOLDING CONTAINERS

[75] Inventor: Stanley Nessfield, Driffield, England

[73] Assignee: Sea Containers Limited, London, England

[21] Appl. No.: 210,195

[22] Filed: Nov. 25, 1980

[30] Foreign Application Priority Data

Nov. 27, 1979 [GB] United Kingdom ..... 7940916

[51] Int. Cl.[3] ..... B65J 1/02; B65D 7/26

[52] U.S. Cl. ..... 220/1.5; 220/7; 108/55.3

[58] Field of Search ..... 220/1.5, 6, 7; 217/0.5; 178/55.1, 55.3, 55.5

[56] References Cited

U.S. PATENT DOCUMENTS 3,765,556 10/1973 Baer ..... 220/7 X

FOREIGN PATENT DOCUMENTS 2719277 11/1978 Fed. Rep. of Germany ..... 220/7

*Primary Examiner*—William Price

*Assistant Examiner*—Gary E. Elkins

*Attorney, Agent, or Firm*—Blanchard, Flynn, Thiel, Boutell & Tanis

[57] ABSTRACT

A folding container has a base for carrying goods and end walls with corner posts articulated to the base by pins. Each corner post has a heel which just clears a bridge member above its arcuate path of movement. To lock each corner post upright, a locking member can be slid into the gap between the bridge member and the heel parallel to the axis of articulation to transmit compression forces directly from the heel portion to the bridge member.

12 Claims, 8 Drawing Figures

FOLDING CONTAINERS

FIELD OF THE INVENTION

The present invention relates to folding containers which, in their erect condition, can be loaded with goods and stacked one upon another and which, after unloading, can be folded flat and stacked for transit in an empty condition. The invention is particularly concerned with constructing such containers to comply with the I.S.O. Standards laid down by the International Standards Organization.

BACKGROUND OF THE INVENTION

A folding container according to the present invention comprises a generally rectangular container base on which goods may be loaded, and corner posts articulated to each corner of the base for movement between a folded-down position, in which the corner posts lie substantially flat on the base, and an erect position, in which the corner posts extend substantially vertically upwards for supporting a superimposed container or stack of containers, wherein each corner post has a heel portion having a locking abutment surface which in the erect position of the corner post faces a locking abutment surface of the base, the respective locking abutment surfaces of the corner post and base being spaced by a sufficient gap to permit the heel portion to swing past the locking abutment surface of the base during movement of the post between its erect and folded-down positions, and a locking member, slidable across the heel portion, in the erect position, into the gap to block movement of the corner post to the folded-down position.

With this arrangement, when the corner post is locked in its erect position, any longitudinal racking forces applied to the upper end of the corner post (for example by a superimposed container) are withstood by compression forces applied to the locking member by the locking abutment surfaces of the corner post and base. The areas of contact between the locking abutment surfaces and the locking member can be chosen to be sufficiently large to avoid risk of damage even when the locking member is not a tight fit between the locking abutment surfaces.

Thus, the locking member can be arranged with a freely sliding fit (with predetermined small clearance) between the locking abutment surfaces and so can easily be manipulated (for example by hand) during erection or folding down of the container.

This is in contrast with a known arrangement where the locking member which prevents the corner post folding down is in the form of a sliding cylindrical shear pin. If the shear pin is slack in the holes in which it is engaged, it only makes line contact with them, with resultant risk of damage, whereas if it is a tight fit, it is difficult to manipulate and this may be aggravated by corrosion.

BRIEF DESCRIPTION OF THE DRAWINGS

An embodiment of the invention will now be described by way of example with reference to the accompanying drawings, in which.

DETAILED DESCRIPTION

Figure 1:
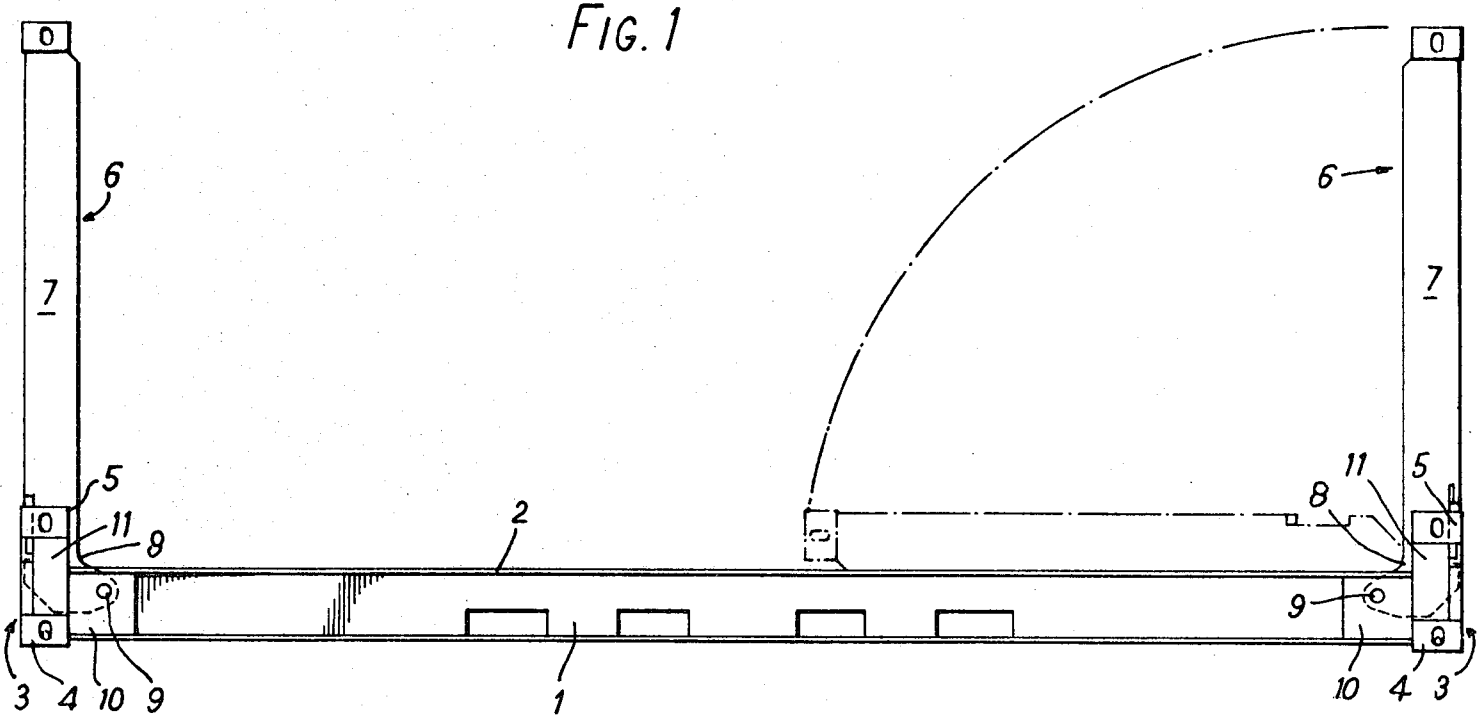
FIG. 1 is a side elevational view of a collapsible container.
Figure 2:
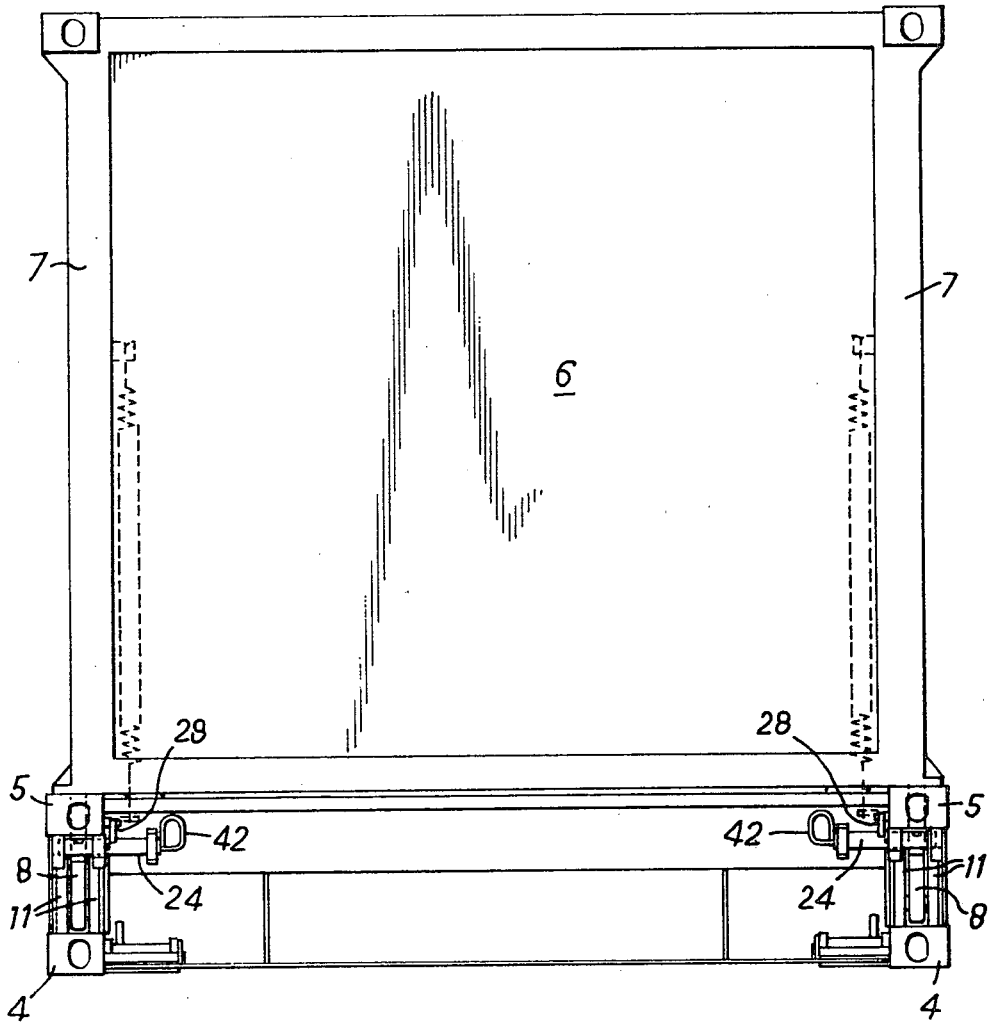
FIG. 2 is an end elevational view on an increased scale of the container shown in FIG. 1.

Referring to FIGS. 1 to 4 of the drawings, a container comprises a fabricated steel base 1 having a load carrying surface 2 formed by timber planking. At each end, the base 1 includes a stub-corner post 3 which incorporates a standard bottom I.S.O. corner casting 4 and a modified I.S.O. top corner casting 5.

The container includes a pair of end walls 6 which can be folded down from an erect position to a folded position in which they lie flat on the load-carrying surface 2. Each endwall 6 includes a pair of corner posts 7 the lower ends of which have cranked extensions 8, the lower ends of which are pivoted to the container base 1 by substantial pivot pins 9 which pass through a pair of plates 10 welded to the base 1 of the container.

Figures 3, 4:
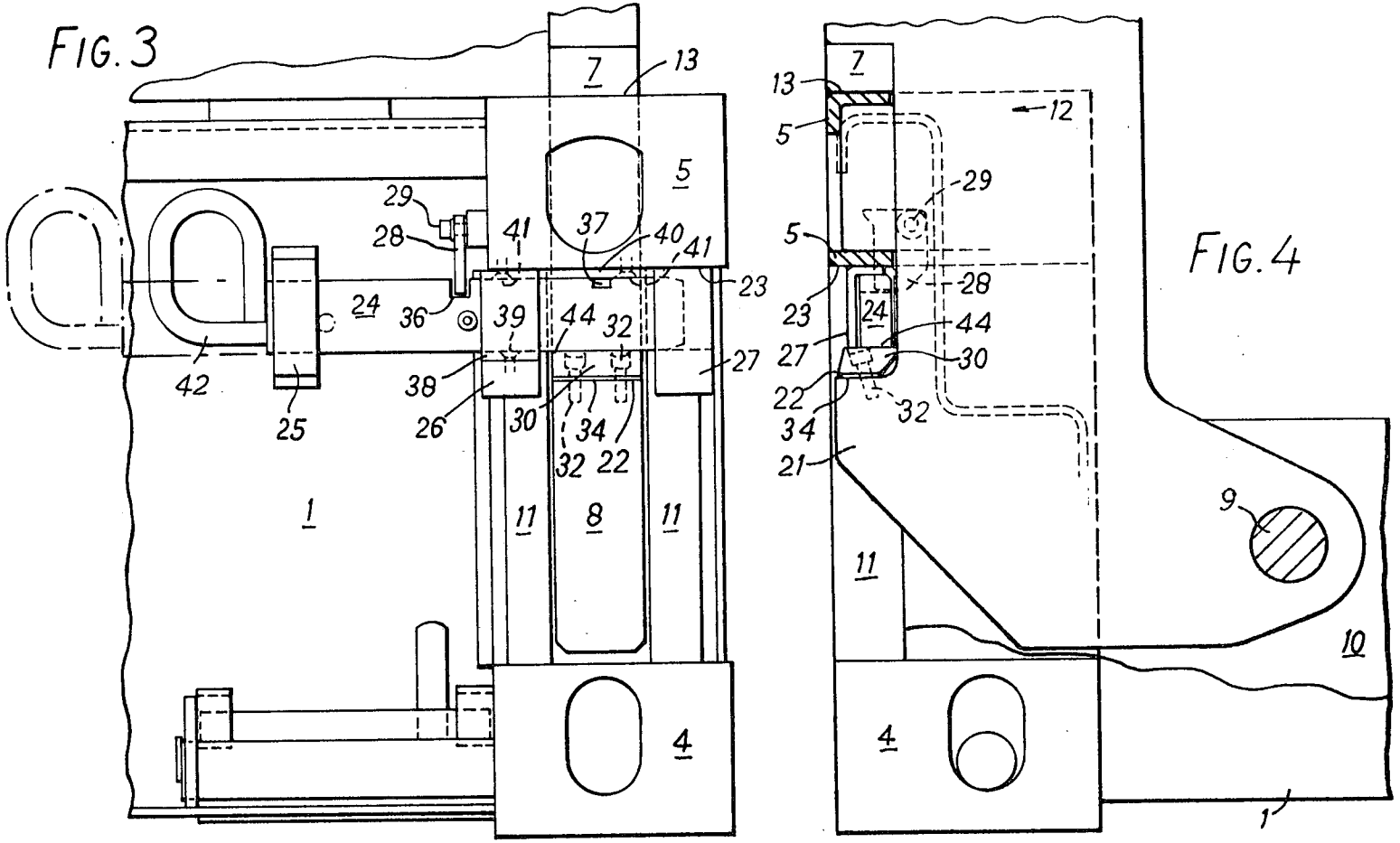
FIG. 3 is a view on an increased scale of the bottom right hand corner of FIG. 2.
FIG. 4 is a view on an increased scale of the bottom left hand corner of FIG. 1 partly in section.
Figure 6:
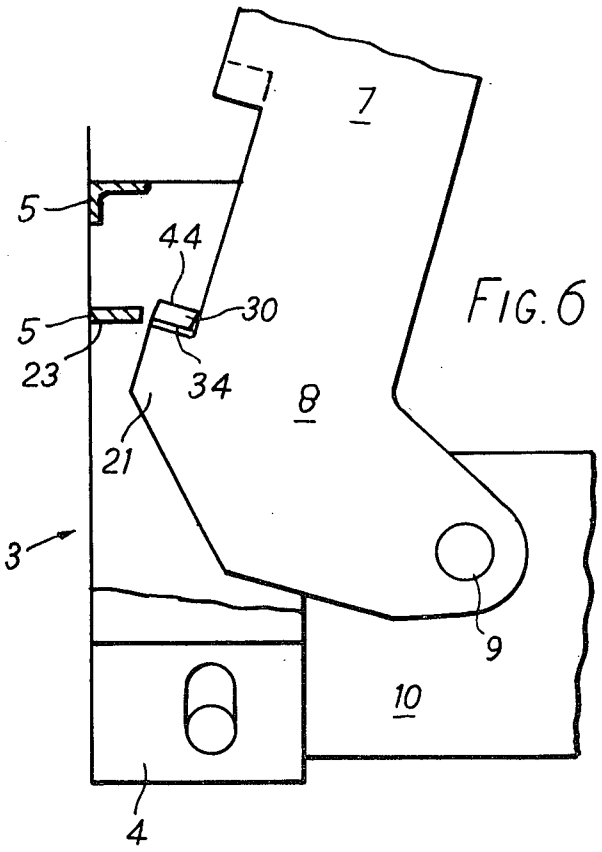
FIGS. 5 to 8 are views similar to FIG. 4 showing successive steps in the lowering on an end wall of the container.
Figure 5:
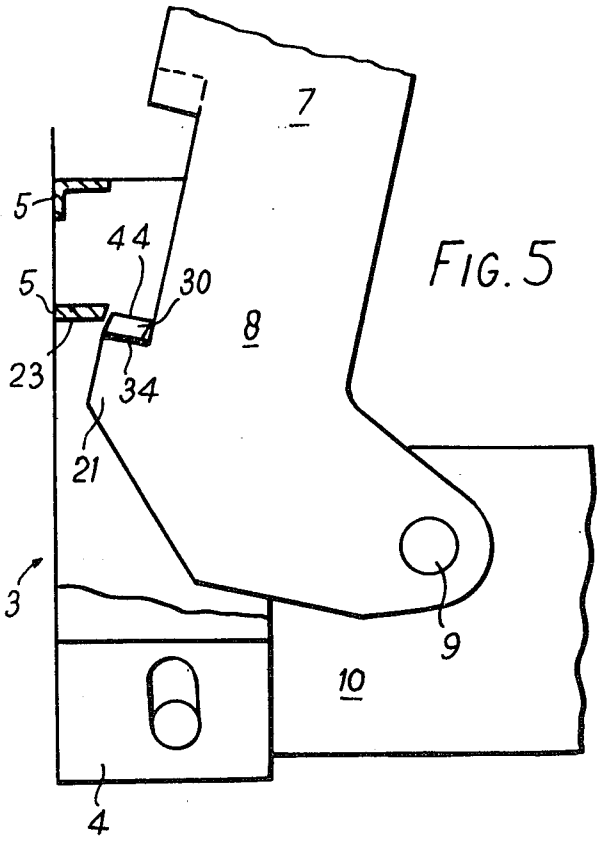
Figure 8:
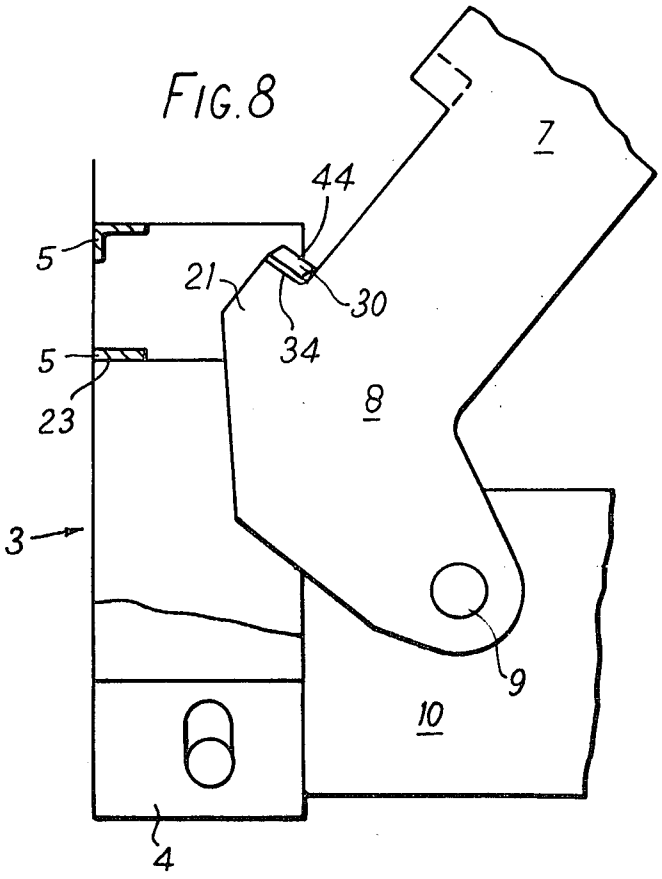
Figure 7:
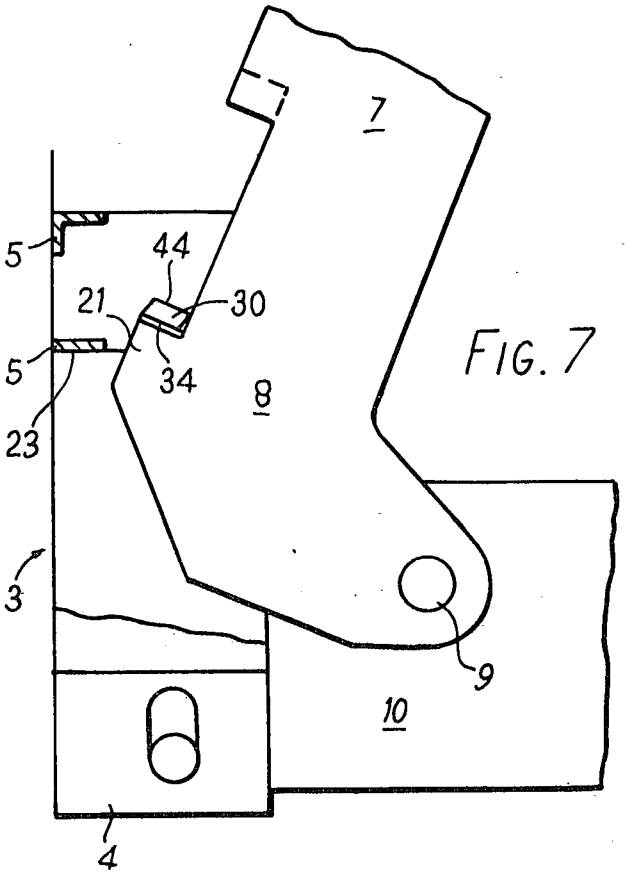

Thus, each stub-corner post 3 is formed by two substantial plates 11 which are separated by a sufficient distance to accommodate the corner post extension 8. The top corner casting 5 of the stub corner post 3 is modified as can be seen in FIG. 4 in that the inner side of its top surface is cut away to convert the conventional top hole into a slot 12 to accommodate the corner post extension 8 in the erect condition. When the container is in its folded condition, other containers (whether folded or erected, or other types of container) may rest on the top face 13 of the top corner casting 5 and be coupled to it by means of a coupling member.

The corner post 7 has a lower edge 14 which overlies the casting 5 in the erect position and the corner post extension 8 has a heel portion 21. A hardened steel fillet 30 is attached to the upper surface 22 of the heel portion 21 by countersunk bolts 32 passing into sockets in the heel portion 21. The fillet 30 has an upper surface 44 adjustable by a shim 34 located between the fillet 30 and the surface 22.

A locking bolt 24 is rectangular in cross-section and is mounted in a guide bracket 25 attached to the container base 1 and inner and outer guide brackets 26, 27 attached to each respective plate 11. A hardened steel fillet 38 is attached to a lower inner surface of the inner guide bracket 26 by a countersunk bolt 39 in order to provide a surface on which the locking bolt 24 may slide. A similar surface is provided on the lower face of the bridge member 23 of the top corner casting 5 by a hardened steel fillet 40, attached by countersunk bolts 41. The bolt 24 may be slid laterally of the container between a "locked" position and an "unlocked" as shown in FIG. 3 in a full and dashed lines respectively. A catch 28 is mounted on a pivot pin 29 on the top corner casting 5 and may engage notches 36 and 37 in the bolt 24 to retain the bolt in the "locked" or "unlocked" positions, respectively. A handle 42 attached to the inner end of the bolt 24 facilitates sliding of the bolt.

During manufacture of the container, and subsequently, if necessary, the upper surface 44 of the fillet 30 of the corner post extension 8 may be adjusted to ensure that the corner post 7 is vertical when in its erect position. It is also ensured that the distance between the surface 44 and the fillet 40 on the lower surface 23 of the top corner casting 5 is greater than the height of the locking bolt by for example 2 mm. The clearance thus provided ensures that the locking bolt 24 may be easily withdrawn from its "locked" position.

To fold the container from the erect condition shown in FIGS. 1 to 4, all that is necessary is to free the catches 28 from the notches 36 and slide each locking bolt 24 inwardly of the container until it is clear of the space between the fillet 40 on the lower surface 23 of the top corner casting 5 and the fillet 30 on the upper surface 22 of the heel 21. The end walls 6 of the container may then fold down into a position where they lie flat on the load-carrying surface 2, as shown in dashed lines in FIG. 1.

FIGS. 5 to 8 show four successive stages during lowering of an end wall 6 of the container. It will be noted from these Figures that the surface 44 of the fillet 30 on the corner post extension 8 and the heel portion 21 itself clear the lower surface 23 and the fillet 40 of the top corner casting 5 during the lowering process.

I claim:

1. A folding container, comprising: a generally rectangular container base on which goods may be loaded; corner posts articulated to each corner of the base for movement between a folded-down position, in which the corner posts lie substantially flat on the base, and an erect position, in which the corner posts extend substantially vertically upwards for supporting a superimposed container or stack of containers; each corner post having a projecting heel portion formed with a first locking abutment surface thereon; said base having a second locking abutment surface thereon which confronts, and is spaced by a gap from, said first locking abutment surface when said corner post is in said erect position; said first locking abutment surface, when said corner post is swingably moved away from its erect position toward said folded-down position, being moved initially towards said second locking abutment surface along an arcuate path so as to swing clear and move past said second locking abutment surface; and lock means positionable in the gap between the first and second locking abutment surfaces and being subject to compressive forces imposed thereon for blocking movement of the corner post away from its erect position toward said folded-down position, said lock means comprising a locking member which is slidable into said gap for substantially filling said gap when the corner post is in its erect position so that the locking member blocks movement of the corner post towards its folded-down position.

2. A container according to claim 1, wherein the first locking abutment surface faces upwardly in the erect position of the corner post, and the second locking abutment surface faces downwardly and is on a portion of the base overlying the heel portion so that the second locking abutment surface is positioned over but spaced from the first locking abutment surface when the corner post is in said erect position.

3. A container according to claim 2, wherein the said portion of the base is a bridge portion interconnecting parts of the base on each side of the path of movement of the heel portion of the corner post.

4. A container according to claim 1 wherein each corner post is prevented from movement beyond its erect position by engagement of further abutment surfaces of the base and the corner post.

5. A container according to claim 3, wherein the said parts of the base are parts of a stub-corner post and the bridge portion is at the top of the stub-corner post, each corner post being prevented from movement beyond its erect condition by engagement of further abutment surfaces on the top of the bridge portion and on the corner post.

6. A container according to claim 1, wherein a clearance is left between the locking member and at least one of the locking abutment surfaces of the base and corner post.

7. A container according to claim 1 in which the locking member is slidable in guides into and out of the gap.

8. A container according to claim 1 wherein at least one of the locking abutment surfaces is on a pre-formed element secured to the corner post or base respectively.

9. A container according to claim 8, wherein a preselected shim is positioned under the pre-formed element.

10. A container according to claim 1, wherein the first locking abutment surface comprises an enlarged flat surface which faces upwardly when the respective corner post is in its erect position, and the second locking abutment surface comprises an enlarged flat surface which is formed on a portion of the base and faces downwardly, said second locking abutment surface being positioned substantially directly over and spaced upwardly from the first locking abutment surface when the corner post is in said erect position, and said locking member comprising an elongated bar of rectangular cross section having enlarged flat upper and lower surfaces which respectively engage said second and first locking abutment surfaces when the corner post is in its erect position so that said locking bar is subject substantially solely to compressive forces when blocking any tendency for the corner post to swing into its folded-down position.

11. A container according to claim 10, wherein the base includes first and second guide parts fixed thereto and horizontally spaced apart so as to define an open region therebetween for receiving therein the projecting heel portion of the corner post when the latter is in its erect position, said base also having a bridge portion fixed thereto and extending between said guide parts directly above said region, said bridge part having a lower surface thereon which defines said second locking abutment surface, said first and second guide parts having aligned openings therein for slidably supporting and receiving said locking member, said locking member being movable between a locking position wherein it bridges the region and is supported on the first and second guide parts and an unlocking position wherein it is withdrawn from the region and is supported only on the first guide part, and releasable latch means mounted on the base and coacting with the locking member for permitting the locking member to be latched in both its locking position and its unlocking position.

12. A container according to claim 10 or claim 11, wherein both the base and the projecting heel portion have a removable wear plate attached thereto for defining the respective locking abutment surface.

* * * * *